US007344744B2

(12) United States Patent
Sierra-Gomez et al.

(10) Patent No.: US 7,344,744 B2
(45) **Date of Patent: *Mar. 18, 2008**

(54) RESEALABLE FOOD CONTAINER WITH TAMPER-EVIDENT INDICATOR

(75) Inventors: Gladys Odette Sierra-Gomez, Woodbridge, NJ (US); Eva Marie Peters, Cedar Grove, NJ (US); Joseph Stiener, Warren, NJ (US); Daniel Michel Bonenfant, Amherst, NH (US); William C. Schieber, Parsippanny, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 291 days.

This patent is subject to a terminal disclaimer.

(21) Appl. No.: 11/029,651

(22) Filed: Jan. 6, 2005

(65) Prior Publication Data

US 2005/0247764 A1 Nov. 10, 2005

Related U.S. Application Data

(63) Continuation-in-part of application No. 10/414,502, filed on Apr. 16, 2003, now Pat. No. 6,918,532.

(51) Int. Cl.

| | |
|---|---|
| ***B65D 85/00*** | (2006.01) |
| ***B65D 25/10*** | (2006.01) |
| ***B65D 33/00*** | (2006.01) |
| ***B65D 65/26*** | (2006.01) |
| ***B65D 75/28*** | (2006.01) |

(52) U.S. Cl. ..... 426/119; 206/459.1; 229/87.08; 383/5; 383/203; 383/205

(58) Field of Classification Search ..... 206/459.1, 206/494, 807, 459.5; 229/87.05, 87.08; 383/5, 383/66, 203–206, 210–211; 426/106, 119, 426/122–124; 428/40.1, 41.7–41.8, 42.1
See application file for complete search history.

(56) References Cited

U.S. PATENT DOCUMENTS

| | | | | |
|---|---|---|---|---|
| 3,740,238 | A | 6/1973 | Graham | |
| 4,156,493 | A | 5/1979 | Julius | |
| 4,185,754 | A | 1/1980 | Julius | |
| 4,197,949 | A | 4/1980 | Carlsson | |
| 4,552,269 | A | 11/1985 | Chang | |
| 4,840,270 | A | 6/1989 | Caputo et al. | |
| 4,848,575 | A | 7/1989 | Nakamura et al. | |
| 4,876,123 | A * | 10/1989 | Rivera et al. | 206/807 |

(Continued)

FOREIGN PATENT DOCUMENTS

| | | |
|---|---|---|
| EP | 0 474 981 | 3/1992 |
| EP | 1 375 380 | 1/2004 |
| FR | 1327914 | 4/1963 |
| JP | 2000335542 | 12/2000 |

*Primary Examiner*—Bryon P Gehman
(74) *Attorney, Agent, or Firm*—Stites & Harbison PLLC; Marvin Petry

(57) ABSTRACT

A container for a food product includes a wrapper which surround a polygonal frame. The wrapper forms a top of the container and has an access opening. A sealing label, adhesively sealed to the top around the opening, is resealable when a tab of the sealing label is pulled back. The sealing label is resealable against the top layer to seal the opening when the sealing label is moved back against the top. Various tamper-evident structures are provided to indicate when the container has been initially opened or tampered with.

55 Claims, 9 Drawing Sheets

U.S. PATENT DOCUMENTS 5,082,702 A * 1/1992 Alband ..... 206/459.5
5,503,858 A 4/1996 Reskow
5,647,506 A 7/1997 Julius
5,688,394 A 11/1997 McBride, Jr. et al.
5,725,311 A 3/1998 Ponsi et al.
D394,605 S 5/1998 Skiba et al.
5,791,465 A 8/1998 Niki et al.
5,938,013 A 8/1999 Palumbo et al.
5,945,145 A 8/1999 Narsutis et al.
6,029,809 A 2/2000 Skiba et al.
6,065,591 A 5/2000 Dill et al.
6,113,271 A 9/2000 Scott et al.
6,126,009 A 10/2000 Shiffler et al.
6,164,441 A 12/2000 Guy et al.
D447,054 S 8/2001 Hill
6,309,105 B1 10/2001 Palumbo
6,420,006 B1 7/2002 Scott
6,428,867 B1 8/2002 Scott et al.
6,517,243 B2 2/2003 Huffer et al.
6,589,622 B1 * 7/2003 Scott ..... 428/40.1
6,746,743 B2 6/2004 Knoerzer et al.
6,767,604 B2 7/2004 Muir, Jr. et al.
6,918,532 B2 7/2005 Sierra-Gomez et al.
2003/0210838 A1 11/2003 Steele
2006/0018569 A1 1/2006 Bonenfant

* cited by examiner

RESEALABLE FOOD CONTAINER WITH TAMPER-EVIDENT INDICATOR

RELATED APPLICATIONS

This application is a continuation-in-part of U.S. patent application Ser. No. 10/414,502, filed Apr. 16, 2003, now U.S. Pat. No. 6,918,532.

FIELD OF THE INVENTION

The present invention relates to a resealable container, and in particular, a new and improved resealable container having a reclosable sealing label which can be pulled back and reclosed against a top portion of the container and which includes a product integrity indicator which is generally referred to in the art as a tamper-evident indicator.

BACKGROUND OF THE INVENTION

Containers for food products such as cookies and other snacks typically include a frame surrounded by an outer wrapper. The frame acts as a tray to hold the food product and to protect the food product from damage. One normally gains access to the contents of the container by opening one end of the wrapper, withdrawing the tray from the inside thereof, and then removing the food product from the tray. However, these containers generally do not provide a convenient opening and reclosing arrangement. For example, reclosing of the wrapper, once opened, generally includes simply folding or rolling the end down and clipping the end to keep the wrapper closed.

Reclosable seals have been used for dispensing bags for wet tissues or disposable cleaning wipes. The labels on these bags can be pulled back, thereby exposing an opening, allowing access to the wet tissues or wipes inside. Typically, these dispensing bags are completely flexible, formed exclusively of a plastic or other suitable flexible material which closely surrounds the pack of wet tissues or wipes. Examples of these dispensing bags include U.S. Pat. Nos. 4,840,270 and 6,026,953, U.S. Design Pat. No. D 447,054 and U.S. Patent Application Publication No. 2002/0182359. However, such known dispensing bags are not well suited for containing food products as these containers fail to provide adequate protection for storing food products.

One reclosable dispensing bag for wet tissues includes a tamper-evident indicator in the form of a plurality of pre-cut patterns, e.g., small ovals formed in the label which seals the bag closed. Upon pulling back the label for the first time, the plurality of ovals remain affixed to the top of the dispensing bag. Thus, the absence of the ovals from the label and their presence on the top of the dispensing bag indicates the bag has been previously opened.

In another prior dispensing bag for moistened tissues, shown in U.S. Pat. No. 6,428,867, tamper evidence is provided by a sealing label with an ink layer in the sealing area which leaves ink indicia in the sealing area to indicate the package has previously been opened.

There is a need in the art for a resealable container suitable for containing food items and which includes a tamper-evident indicator.

SUMMARY OF THE INVENTION

The purpose of the present invention is to provide a new and improved container for food products such as cookies and the like, which container provides adequate protection for the contents thereof, while concurrently facilitating opening of the container wrapper and resealing the seal to protect the contents thereof until the contents are fully consumed, and which container is provided with a tamper-evident indicator that indicates whether the container has been previously unsealed.

This purpose is achieved by providing a suitable container for such food products, in combination with an easily accessible opening seal formed in a surface other than an end surface, which seal can reclose the container during use, and an indicator which indicates whether or not the container has previously been opened.

In accordance with one embodiment, the present invention comprises a polygonal shaped food container comprising a frame defining the polygonal shape of the container which contains a food product. A wrapper surrounds the frame and forms a top of the container. The top has an access opening so as to provide hand access to food contents of the container. A sealing layer is adhesively sealed to the top around the opening. The sealing layer is releasable and closable against the top to seal the opening when the sealing layer is moved back against the top. A tamper-evident structure is associated with the sealing label.

In accordance with one arrangement, the tamper-evident structure may include at least one elongated strip positioned parallel to the direction of pulling back of the sealing layer and which is located in a sealing area between the access opening and the adjacent edge of the container where the sealing layer is adhesively sealed to the top. The elongated strip can be formed from a portion of the top. Upon opening the container for the first time, one end of the elongated strip falls into the container. The sealing layer may include a starter portion such as a tab for grasping the sealing layer at a tab end of the sealing layer. The elongated strip would be located in the sealing area, at least at the tab end of the container.

In various further alternative tamper-evident embodiments of the present invention, the tamper-evident structure comprises tape extending along at least a portion of a perimeter where the sealing layer contacts the top, along both the sealing layer and the top. The tamper-evident tape has to be removed prior to or at the same time the sealing layer is opened for the first time. The tape leaves an indicia on the top after the tape is removed.

In yet another alternative tamper-evident structure, a removable film is disposed under the sealing layer, which film has to be removed in order to gain access to the contents of the container. In yet another form, the tamper-evident structure comprises scored sealed tape extending along at least one portion of a perimeter where the sealing layer contacts the top along both the sealing layer and the top. The scored tape has to be removed prior to or at the same time the sealing layer is opened for the first time. The scored tape leaves a portion of the scored seal tape on the top after the scored tape is removed.

In accordance with another aspect of the present invention, a polygonal food container comprises a frame defining a polygonal shape of the container and containing a food product. A wrapper surrounds the frame and forms the top of the container. The top has an access opening so as to provide access to the food product. A sealing layer is adhesively sealed to the top in a sealing area between the access opening and an adjacent edge of the top. The sealing layer is operable to expose the access opening and closable against the top to seal the access opening. A means is provided for pulling the sealing layer back to open the access opening. A tamper-evident means is located in the sealing area between the access opening and the adjacent edge of the container and constructed such that when the sealing layer opens the access opening for the first time, tamper evidence is provided and is visible after the sealing layer is reclosed.

In accordance with another aspect of the present invention, a container for a food product comprises a wrapper surrounding the food product and forming a top of the container. The top has an access opening so as to provide access to the food product. A sealing layer is adhesively sealed to the top in a sealing area between the access opening and an adjacent edge of the top. The sealing layer is operable to expose the access opening and reclosable against the top to seal the access opening. A means is provided for pulling the sealing layer back to open the access opening. An elongated strip, positioned parallel to the direction of pulling the sealing layer back and located in the sealing area between the access opening and the adjacent edge of the package is constructed such that when the sealing layer opens the access opening for the first time, an end of the elongated strip falls into the container.

In various further embodiments of the container, the elongated strip is formed from a portion of the top and the sealing layer is transparent.

BRIEF DESCRIPTION OF THE DRAWINGS

The invention will now be described in detail with respect to preferred embodiments with reference to the accompanying drawings, wherein.

DETAILED DESCRIPTION OF THE INVENTION

Figure 1:
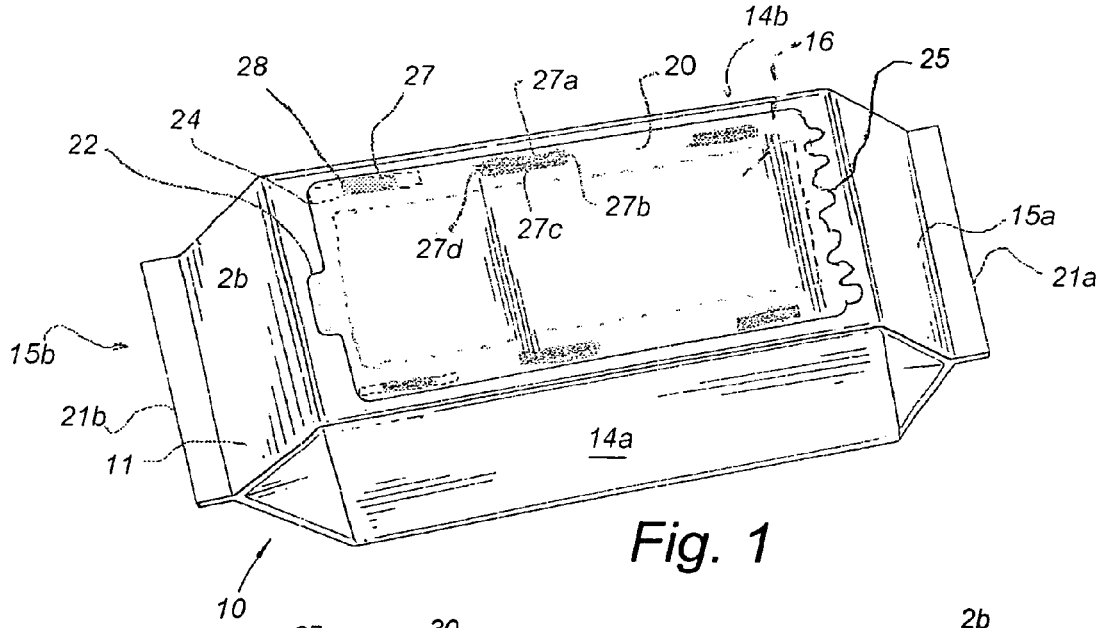
FIG. 1 is a perspective view of a resealable container in accordance with the present invention, in a closed configuration.

Referring now to the drawings, like numbers represent like elements throughout the several views.

Figure 2A:
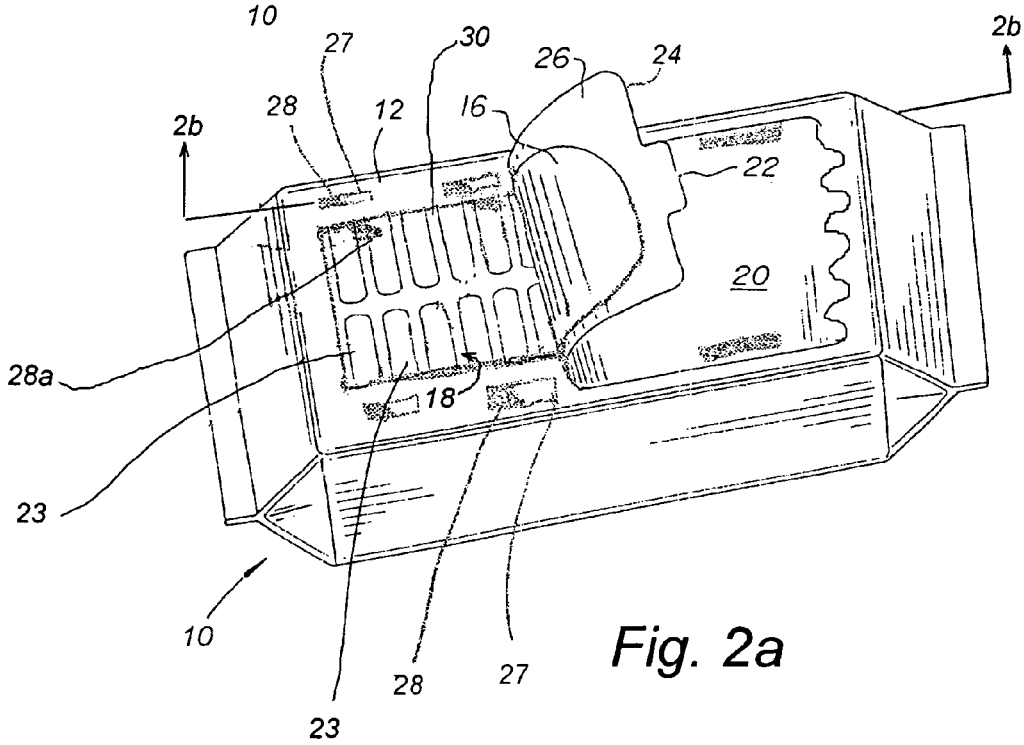
FIG. 2*a* is a perspective view of the container of FIG. 1 in a partially opened condition.
Figure 2B:
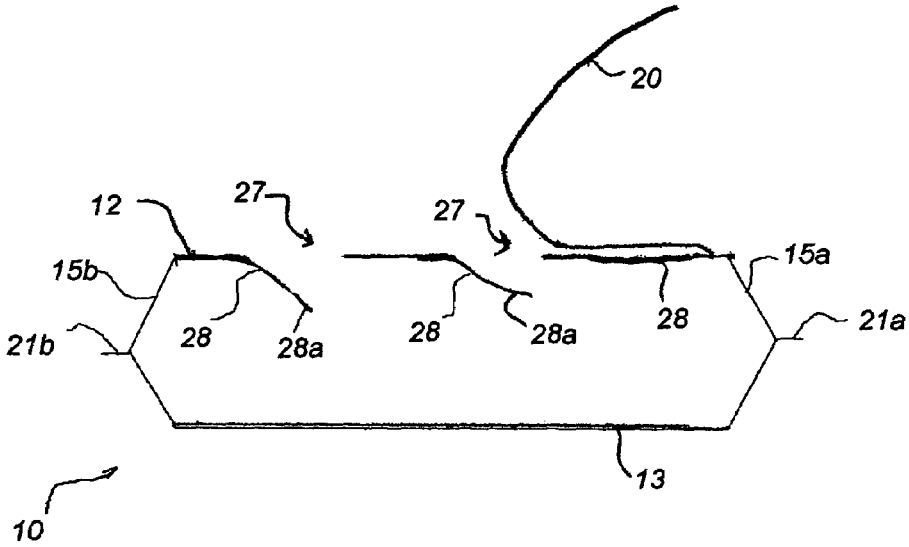
FIG. 2*b* is a sectional view of the container of FIG. 1, taken along line 2*b*-2*b* of FIG. 2*a;*

Referring now specifically to FIGS. 1, 2*a* and 2*b*, resealable container 10 includes a wrapper 11 which forms top 12, bottom 13, opposing sides 14*a* and 14*b*, and opposing ends 15*a* and 15*b*. The flap 16, when pulled back from the container 10, forms an opening 18. The wrapper 11 extends past the ends of top 12 and bottom 13 at ends 15*a* and 15*b*, where the wrapper 11 is crimped together to form crimp seals 21*a*, 21*b*. The overall structure of the container imparts a certain shape to the container, for example as shown in FIG. 1, 2*a* and 2*b*, structure including the tray may impart a certain shape having generally rectangular sides, top, and bottom.

A sealing layer in the form of sealing label 20 is affixed to the flap 16. Advantageously, the sealing label 20 is permanently affixed to the flap 16 using an appropriate adhesive. The sealing label 20 covers a substantial portion of the top 12 extending from the proximity of end 15*b* to the proximity of end 15*a* whereat it has a dovetail end 17, and from the proximity of side 14*a* to the proximity of side 14*b*. The portion of the package in and around the sealing layer may be referred to as an outer surface access area.

The surface area of sealing label 20 is advantageously proportional to the size of opening 18. For example, if the sealing label 20 is too large, the covering could get caught or overlap corners of the container 10, or it could get caught up in the crimp seals 21*a*, 21*b*, both potentially hindering functionality of sealing label 20. Advantageously, the surface area of the sealing label 20 should be approximately 1.5 to 2 times and more preferably around 1.8 times the size of opening 18. Further, it is advantageous to have the size of opening 18 be proportional to the size of the container 10 and food products so that, when the container is still full of food product, the consumer will have easy access to at least 90 percent of the food product 23 inside the container, for example, not requiring one to reach deep inside the container 10 under top 12 in order to gain access to a food item contained therein. Of course as the container 10 is emptied, the consumer can gain easy access to the remaining food product.

Graphics may be formed on the sealing label 20 which align with corresponding graphics on top 12 when the sealing label 20 is sealed or otherwise in a flat position on top 12. Alternatively, sealing label 20 may be transparent, allowing the graphics of top 12 to be visible through sealing label 20.

A starter portion, for example a tab 22 extends from sealing label end 24 opposite dovetail end 17. As a result, tab 22 can be grasped by one's fingers and thumb such that the tab 22 is easily accessible for one to pull. Further, the tab 22 facilitates closing of the container. The size of tab 22 and its shape are optimized for functionality. Advantageously, the tab 22 has a surface area of 1 to 6 percent that of the total surface area of sealing label 20.

Adhesive 26 is applied to the surface of sealing label 20 which is in contact with top 12 along a perimeter around flap 16. Advantageously, adhesive 26 provides a removable seal between the sealing label 20 and top 12. Adhesive 26 is not applied to tab portion 22.

The absence of an adhesive on tab 22 allows a consumer to more easily grasp the starter portion in order to open the container 10 since tab 22 will not be sealed to the top 12. In addition, by giving a consumer a specific portion of the sealing cover to pull, the consumer is not drawn to touching the adhesive portion of the sealing label 20. Such touching could cause the sealing layer to lose its adhesiveness and thus not provide a proper reseal against the top 12 of the container 10. This could, in turn, allow air to gain access to the interior of the container 10 and the food product contained therein.

Container 10 is transformed from a closed condition shown in FIG. 1 to a partially opened condition depicted in FIGS. 2*a*, 2*b* by grasping the tab 22 between ones fingers and thumb and pulling back on the sealing label 20 to gain access to opening 18. Once container 10 is opened, one can remove individual food product 23 contained inside the container 10 through opening 18.

A tamper-evident structure of container 10 includes a plurality of slits 27 surrounding tamper-evident strips 28. Advantageously, sealing label 20 is transparent along its perimeter so that the tamper-evident strips 28 are visible through the sealing label 20.

Tamper-evident strips 28 can be formed using an advantageous method which includes applying sealing label 20 to stock material which comprises wrapper 11. Next, slits 27 are die cut into wrapper 11 from the side opposite the sealing label 20 to form tamper-evident strips 28. Slit 27 is die cut on three sides, sides 27*a*, 27*b* and 27C, but not 27*d*. In one form, the slits are approximately 1.5 inches long and 0.125 inches wide. This method can also be used to form flap 16. The slits 27 farthest to the left (closest to end 15*b*) of FIG. 1 are drawn using broken lines to indicate that the slits 27 can be moved either to the right or to the left.

Prior to opening package 10 for the first time, strips 28 are affixed to the adhesive 26 of sealing label 20. When the sealing label 20 is pulled back for the first time, the strip ends 28*a* fall into the container 10, thus indicating that container 10 has been opened. When sealing label 20 is returned to a flat position along top 12, tamper-evident strips 28 beyond ends 27*d* remain inside container 10. Thus, if the sealing label 20 is transparent, one can immediately see through the label that the strips 28 have fallen into the container, meaning that the container has been opened.

Advantageously, the strips 28 also indicate prior opening of the package if the label 20 is opaque. For this purpose, at least one slit 27 with a respective strip 28 is in close proximity to the end of the access opening 18 proximate the tab 22. This location allows the respective tamper-evident strip 28 to indicate that the container 10 has been previously opened once the sealing layer is just started to be removed, i.e., peeled back, for the first time. As a result, partial peeling back sealing label 20 from top 12 will allow a tamper-evident strip 28 to indicate the container 10 has previously been opened. In other words, only slightly opening of the container 10 will indicate that the container has previously been opened, so that even slight removal of sealing label 20 would indicate the possibility that container 10 has been tampered with.

Figure 12:
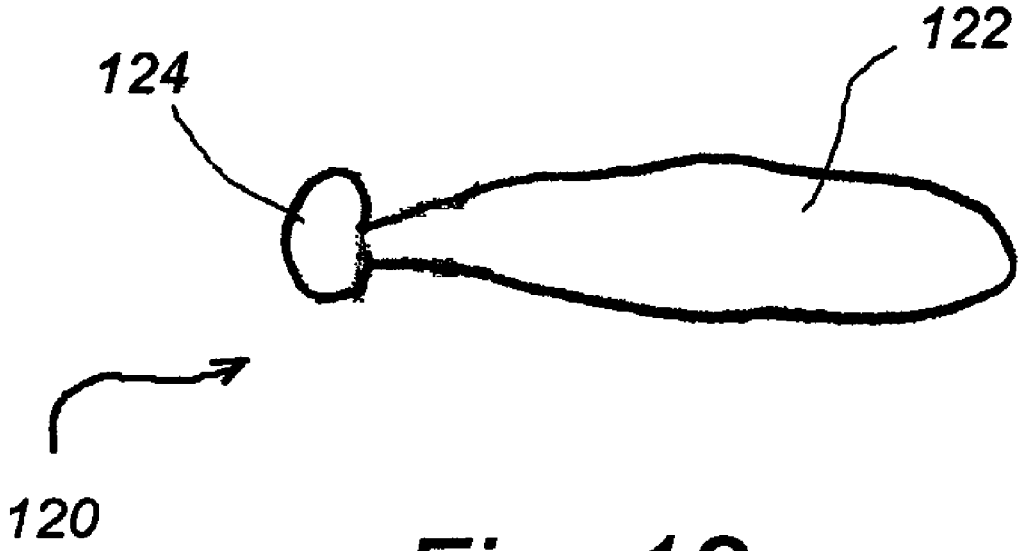
FIG. 12 is a plan view of a different tamper-evident structure in accordance with the present invention.

Tamper-evident strips 28 are depicted in FIGS. 1, 2*a*, and 2*b* as having an elongated rectangular form. Alternatively, the tamper-evident strips can have other forms such as tamper-evident strip 120 depicted in FIG. 12. Tamper-evident strip 120 has a tapered portion 122 with an extension or knob portion 124 resulting in the tamper-evident strip 120 resembling a baseball bat shape.

Figure 3:
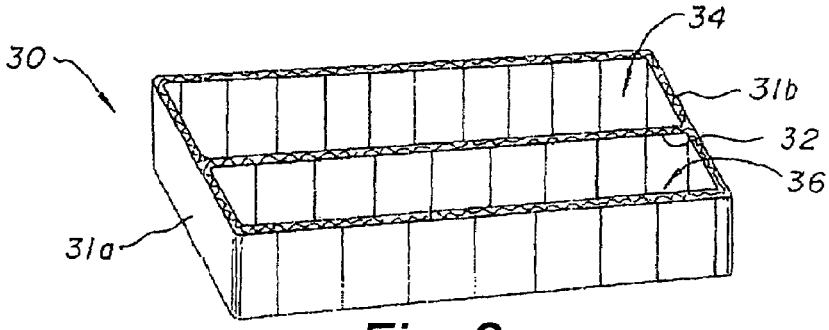
FIG. 3 is a perspective view of a frame of the container of FIG. 1.

Wrapper 11 surrounds a frame 30 which forms a tray for the contents of the food product. Referring to FIG. 3, the frame 30 comprises a rigid material which forms the shape of the container 10. Suitable rigid materials include plastics and cardboard. Frame 30 includes ends 31*a* and 31*b* a divider 32 which divides the frame 30 into a first section 34 and a second section 36.

Frame 30 can be any polygonal shape such as the rectangular shape depicted in FIG. 3. The rectangular shaped frame 30 forms a rectangular shaped container 10. Alternately, different polygonal shaped frames will form containers having the corresponding polygonal shape.

In various alternative embodiments of the present container, alternative tamper-evident structures are provided.

Figure 4A:
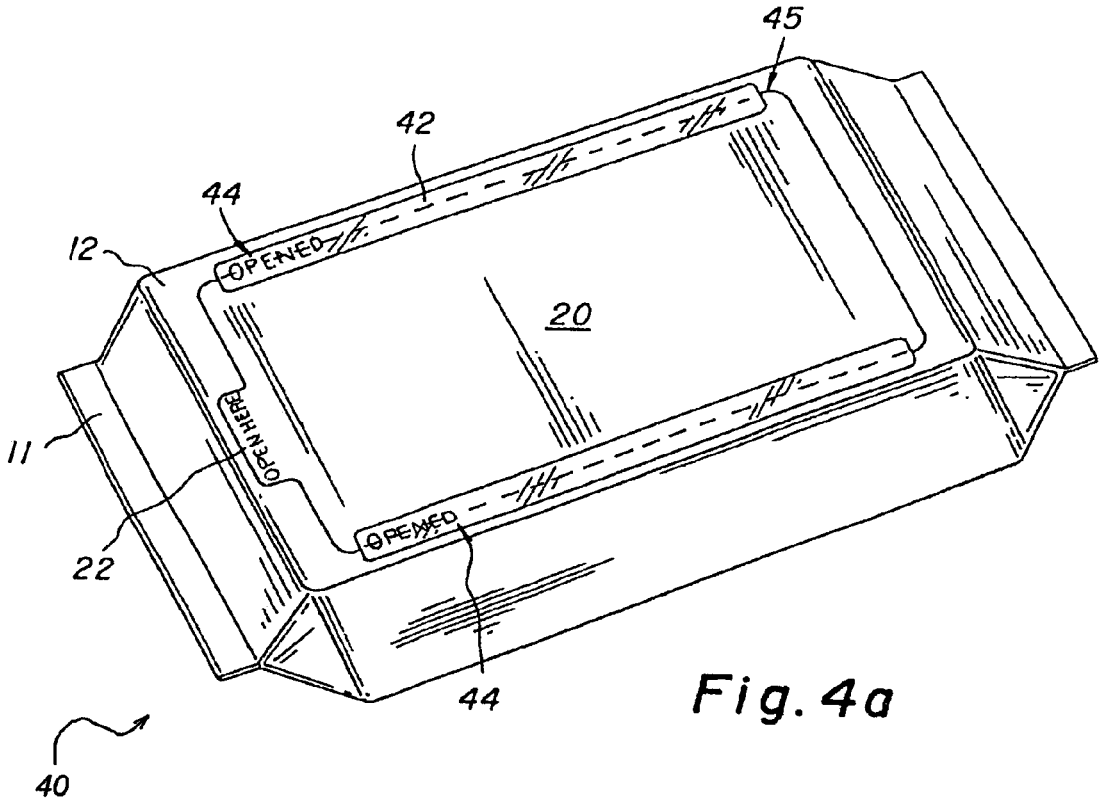
FIG. 4*a* is a perspective view of a resealable food container having another tamper-evident indicator, shown in a sealed condition.
Figure 4B:
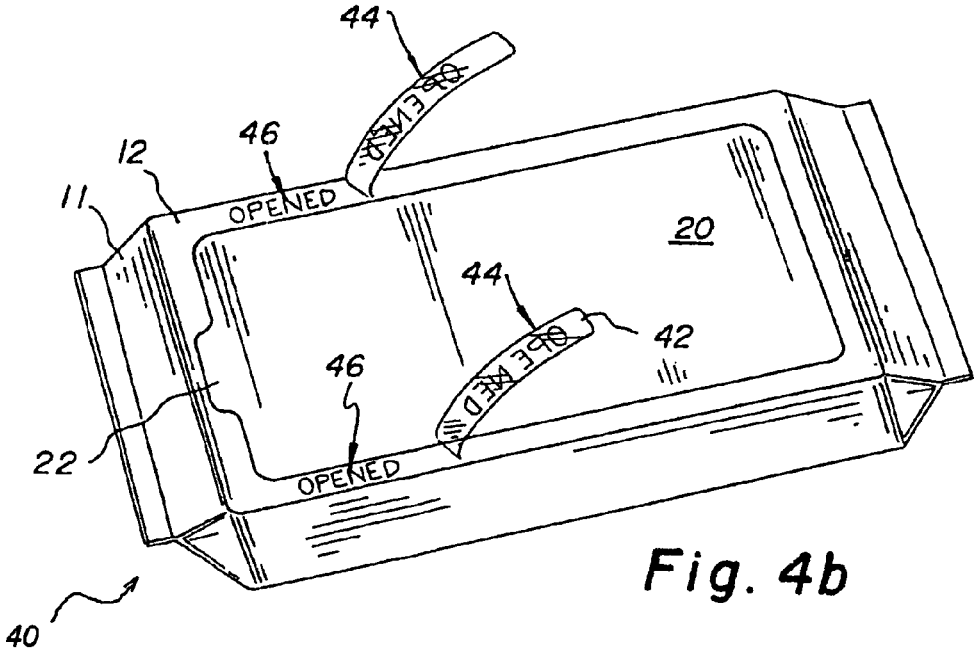
FIG. 4*b* is a perspective view of the container of FIG. 4*a* with the tamper-evident indicator partially withdrawn.

Referring to FIGS. 4*a* and 4*b*, container 40 includes a tamper-evident structure in the form of tamper-evident tape 42 which is applied along two portions of the perimeter 45 where the sealing label 20 contacts the top 12. The tamper-evident tape 42 must be removed prior to or at the same time the sealing label 20 is pulled back for the first time. Once the tamper-evident tape 42 is peeled back from the wrapper 11, indicia 44 from the tamper-evident tape 42 remains on the top 12 as evidence that the tamper-evident tape 42 had been previously removed. For example, the indicia of lettering "OPENED" 46 in FIG. 4*b* evidences that the tamper-evident tape 42 has been removed.

Figure 5:
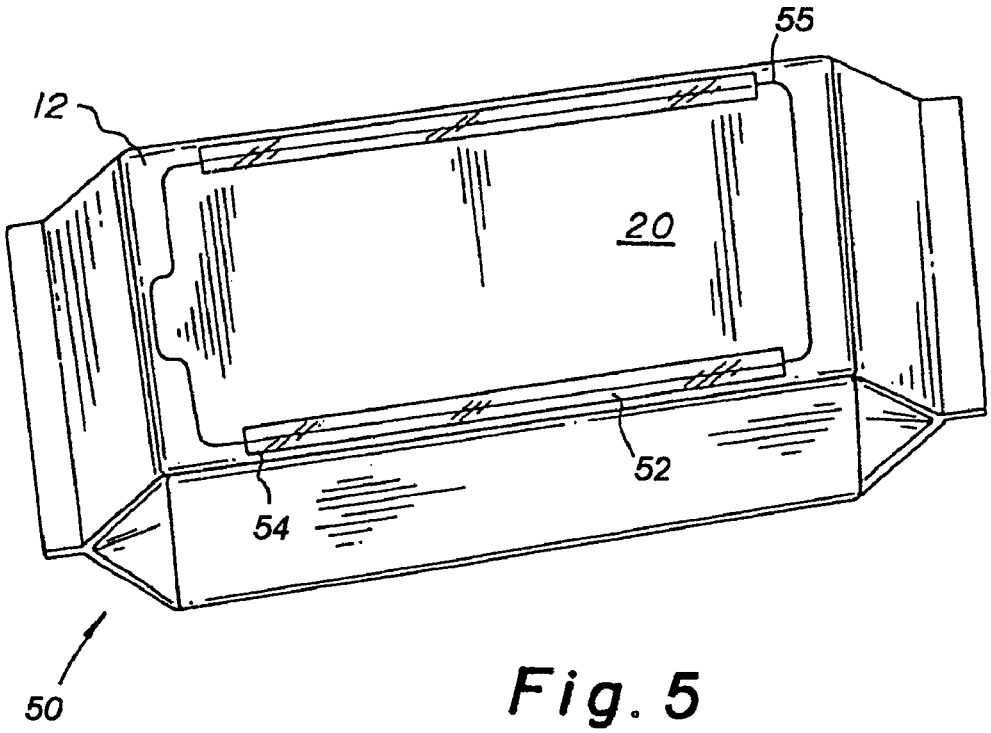
FIG. 5 is a perspective view of a resealable container having another tamper-evident indicator.

Referring now to FIG. 5, yet another tamper-evident structure is provided in container 50 which includes scored seal tape 52 which is placed along two portions of the perimeter 55 where the sealing label 20 contacts the top 12. When the sealing label 20 is pulled back from the top 12 for the first time, portion 54 of the scored seal tape 52 remains on top 12 thereby indicating that the seal layer 20 previously has been removed from the container 50.

Figure 6A:
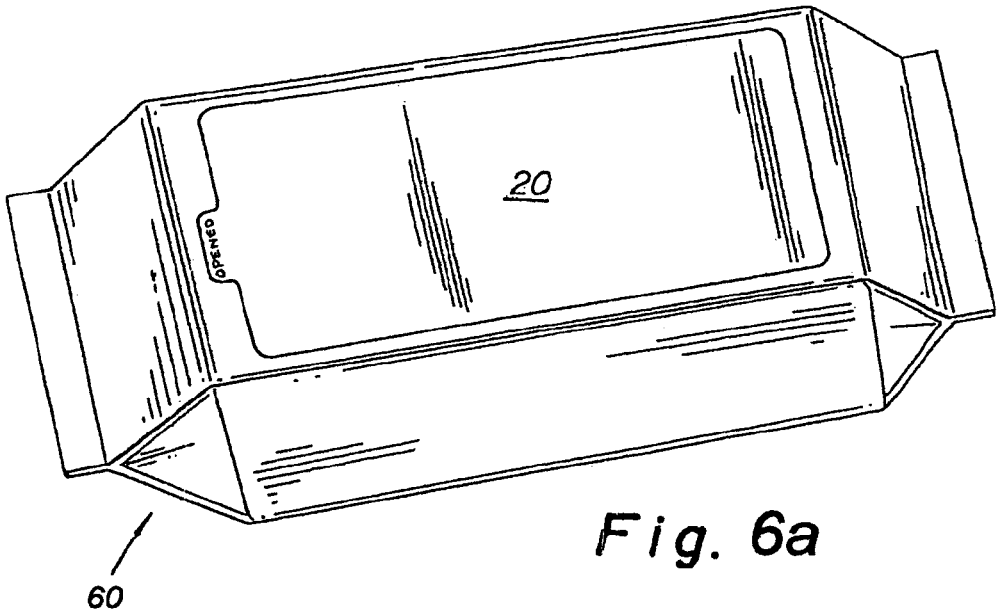
FIG. 6*a* is a perspective view of a resealable container with another tamper-evident indicator, shown in a sealed condition.
Figure 6B:
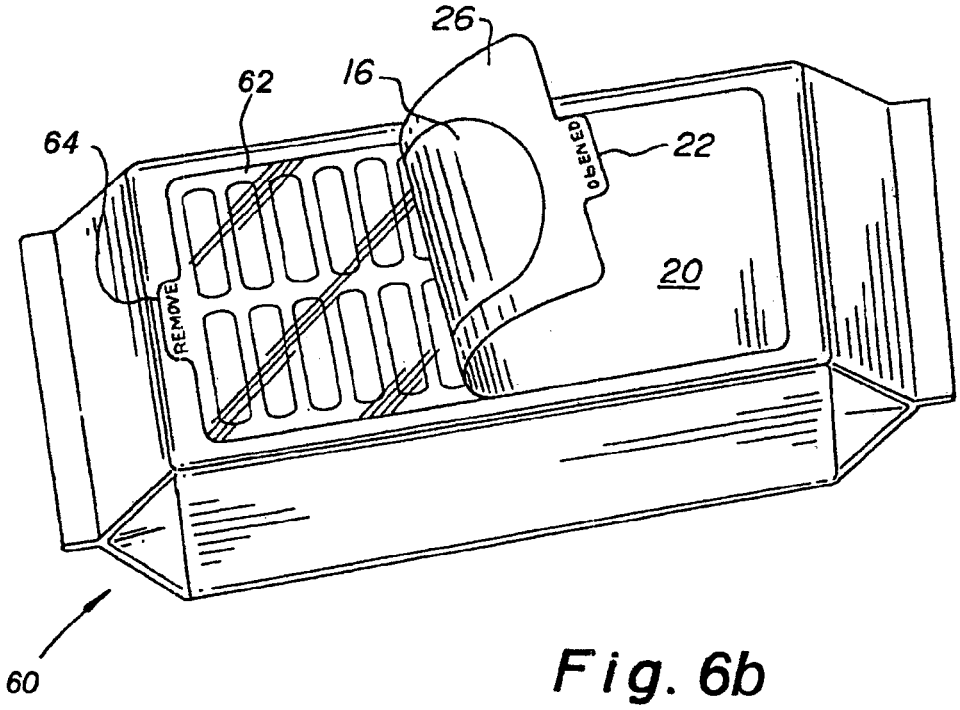
FIG. 6*b* is a perspective view of the container of FIG. 6*a* shown in a partially opened condition.

Referring to FIGS. 6*a* and 6*b*, in an alternative tamper-evident structure, container 60 includes a film 62 disposed under the sealing label 20. The film 62 may be plastic or foil and includes a film tab 64 which one pulls to remove the film 62. In use, one opens the container 60 in the same manner as container 10 and then removes and discards the removable film 62 to gain access to the food contents contained within the container 60. To reseal the container 60, sealing label 20 is moved back to a flat position as depicted in FIG. 6*a*.

Figure 7:
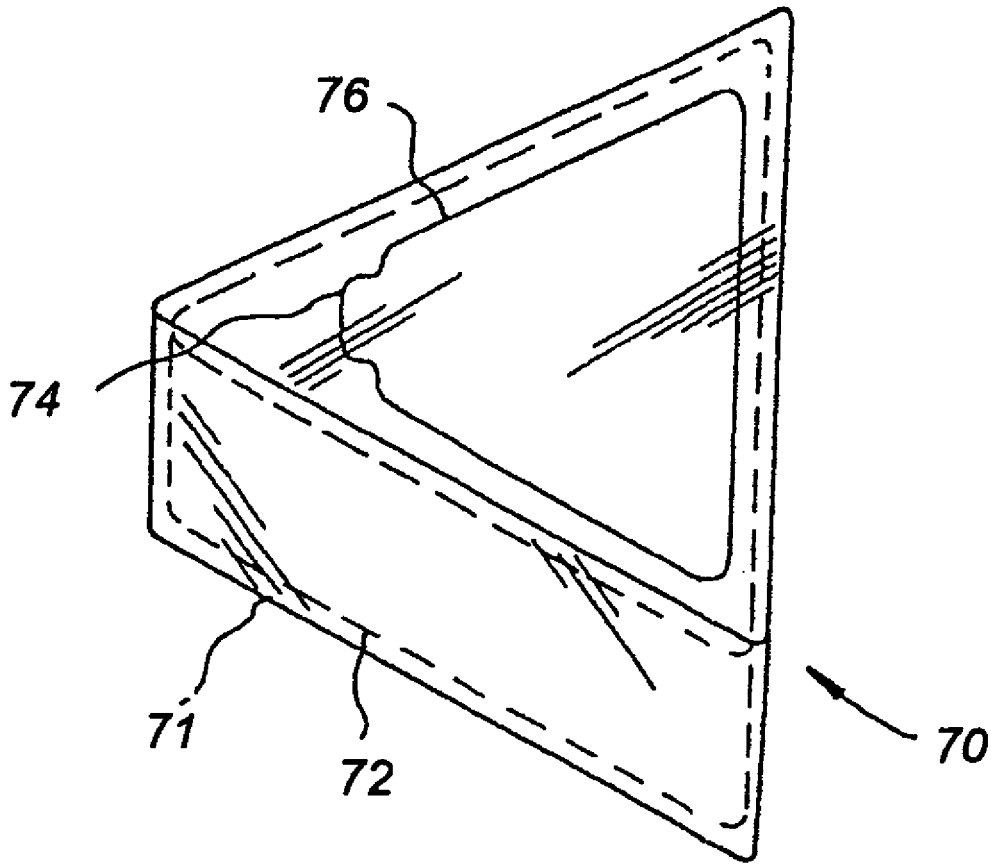
FIG. 7 is a perspective view of a different polygonal shaped resealable food container.
Figure 8:
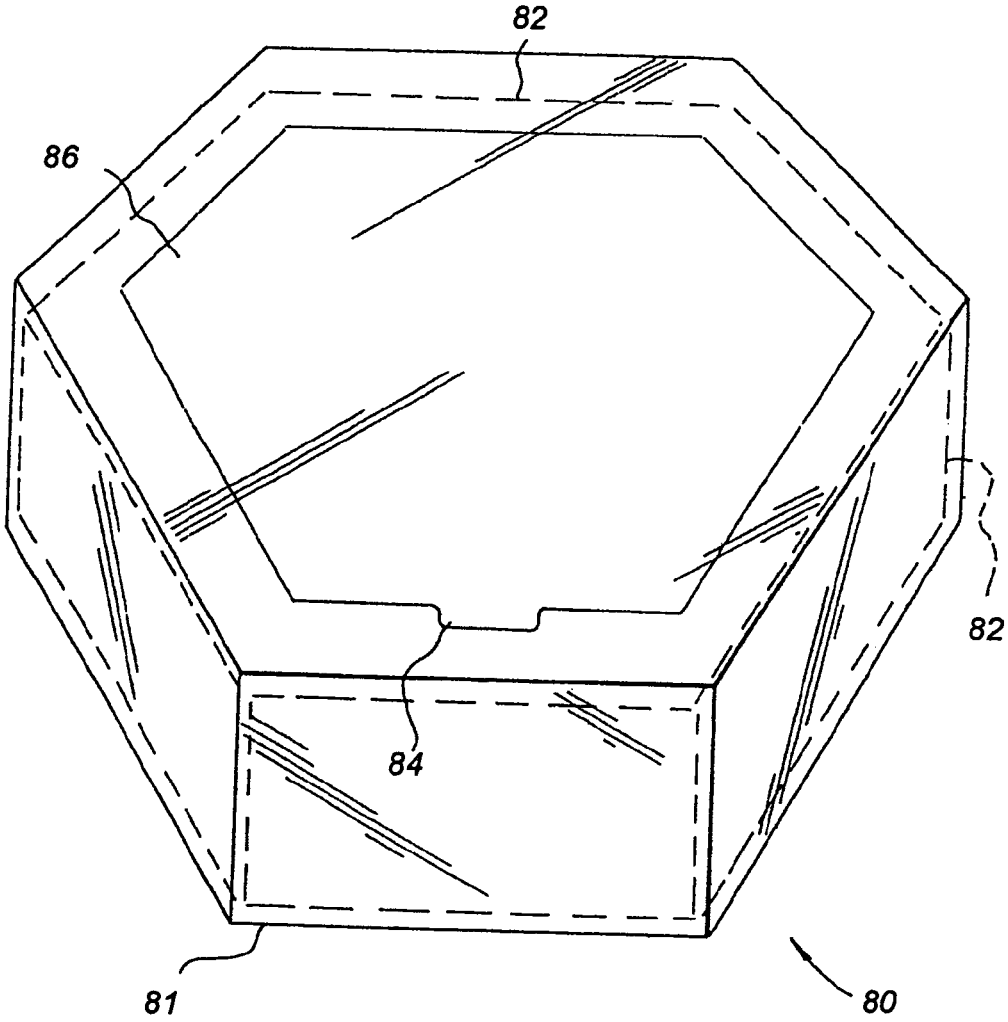
FIG. 8 is a perspective view of a different polygonal shaped resealable food container.

In an alternative embodiment, rather than a rectangular container, the container may be in the form of any polygonal shaped container. As previously discussed, the polygonal shape of the container takes its form from the frame which is covered by a wrapper. For example, referring to FIG. 7, container 70 comprises a triangular shaped polygonal container formed by wrapper 71 surrounding frame 72. In an alternative polygonal shape, FIG. 8 depicts container 80 in the shape of a hexagon defined by wrapper 81 surrounding frame 82. As in the embodiment of FIGS. 1 and 2, one gains access to the contents of containers 70, 80 by pulling back on tabs 74, 84 of sealing label 76, 86, respectively.

Figure 10:
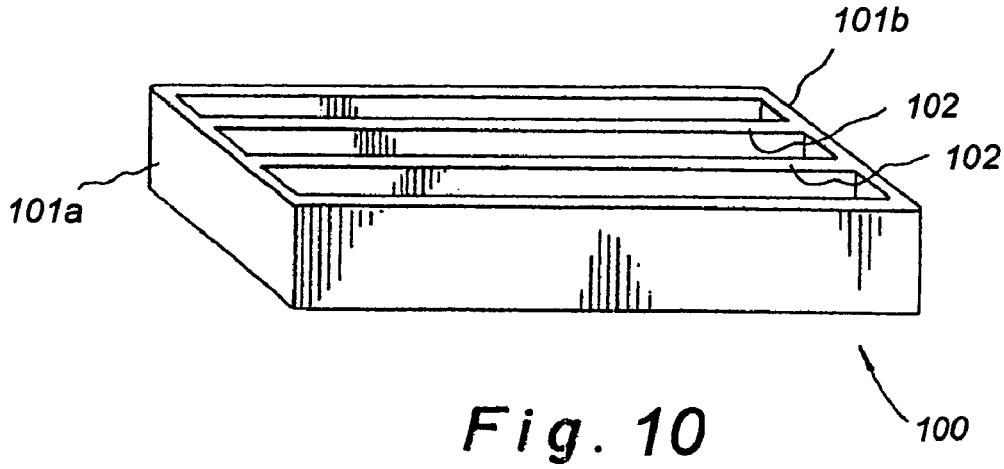
FIG. 10 is a perspective view of another frame for a resealable food container.
Figure 9:
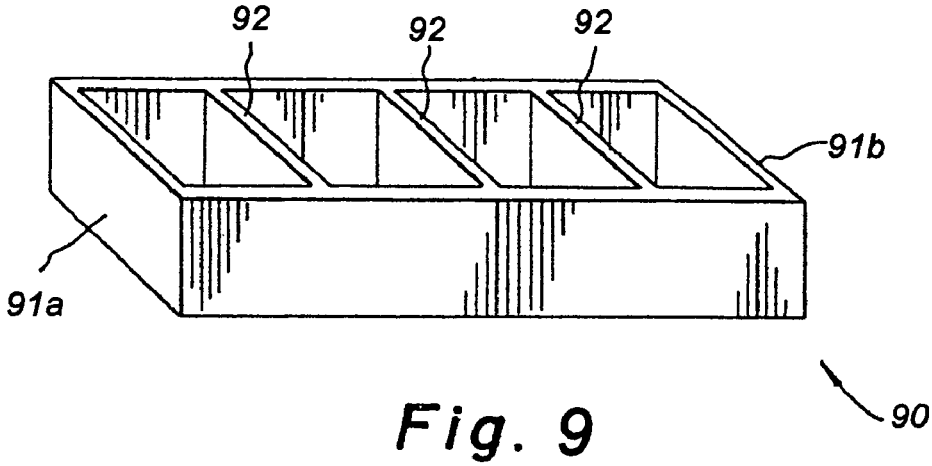
FIG. 9 is a perspective view of a frame for a resealable food container in accordance with the present invention.
Figure 11:
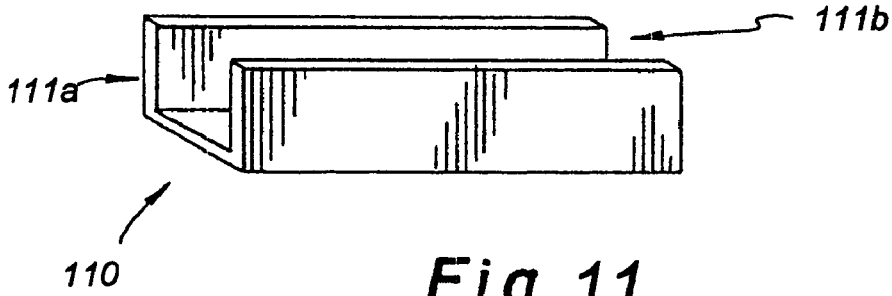
FIG. 11 is a perspective view of another different frame for a resealable food container.

In other alternative embodiments, frames other than frame 30 can be used. For example, referring to FIG. 9, frame 90 includes a plurality of dividers 92 which extend transversely across the width of the frame 90. Alternatively, frame 100 includes a plurality of dividers 102 extending longitudinally along the length of frame 100 (FIG. 10) and frame 110 (FIG. 11) does not include a divider at all. Selection of a particular frame depends on the desired use. Further, the various frames may include ends such as frames 30, 90 and 100 which have ends 31*a*, 31*b*, 91*a*, 91*b*, 101*a*, 101*b*; or the frame may be opened at the ends such as frame 110 with opened ends 111*a*, 111*b*.

The present invention offers numerous features and advantages over previous food containers. For example, in one form, the present invention includes a tab element which extends beyond a corner of a top or side of the container which makes the tab easily accessible for being grasped and for withdrawing a sealing label from the container.

An additional feature of the present invention is provided by a resealable sealing label which can be pulled back and then resealable against a top portion of the container. This makes it possible to gain easy access to the food product within the container without having to open the end of the container, withdraw a tray containing the food product, remove the food product from the tray, return the tray back to the container, and close off the end of the bag.

A further feature of the present invention is a tamper-evident structure which indicates whether the container has been previously opened. This tamper-evident structure allows a consumer to know whether the container has been previously opened. Further, the tamper-evident structure helps ensure that the contents are fresh by indicating whether the container has been previously opened.

Although the invention has been described in detail with respect to preferred embodiments thereof, it will be apparent to one of ordinary skilled in the art that the invention is capable of numerous modifications and variations within the scope and spirit of the invention.

We claim:

1. A polygonal shaped food container comprising:

a frame defining the polygonal shape of the container which contains the food product;

a wrapper surrounding said frame, said wrapper forming a top of the container;

said top having an access opening so as to provide hand access to food product of the container;

a sealing layer, adhesively sealed to said top around said opening, said sealing layer being releasable and reclosable against said top to seal said opening when said sealing layer is moved back against said top; and a tamper-evident structure associated with said sealing layer.

2. The polygonal shaped food container of claim 1, wherein said tamper-evident structure comprises at least one elongated strip parallel to the direction of pulling the sealing layer back and located in a sealing area between the access opening and the adjacent edge of the container where said sealing layer is adhesively sealed to said top.

3. The polygonal shaped food container of claim 2, wherein said at least one elongated strip is formed from a portion of said top.

4. The polygonal shaped food container of claim 2, wherein one end of said at lease one elongated strip falls into said container when said sealing layer is peeled back for a first time.

5. The polygonal shaped food container of claim 2, wherein the sealing layer includes a tab for grasping the sealing layer at a tab end of the sealing layer and said at least one elongated strip is located in the sealing area at the tab end.

6. The polygonal shaped food container of claim 2, wherein said elongated strip comprises a tapered form with a knob extension end.

7. The polygonal shaped food container of claim 1, wherein said tamper-evident structure comprises tape extending along at least a portion of a perimeter where said sealing layer contacts said top, along both said sealing layer and said top, said tamper-evident tape having to be removed prior to or at the same time said sealing layer is opened for a first time, said tape leaving an indicia on said top after said tape is removed.

8. The polygonal shaped food container of claim 1, wherein said tamper-evident structure comprises a removable film disposed under said sealing layer, said film having to be removed from the food container to gain access to the contents of the container.

9. The polygonal shaped food container of claim 1, wherein said tamper-evident structure comprises scored seal tape extending along at least a portion of a perimeter where said sealing layer contacts said top, along both said sealing layer and said top, said scored tape having to be removed prior to or at the same time said sealing layer is opened for a first time, said scored seal tape leaving a portion of the scored seal tape on said top after said scored seal tape is removed.

10. The polygonal shaped food container of claim 1, wherein the sealing layer includes a tab for grasping the sealing layer.

11. A polygonal food container comprising, a frame defining the polygonal shape of the container and containing a food product;

a wrapper surrounding the frame, said wrapper forming a top of the container;

the top having an access opening so as to provide access to the food product;

a sealing layer adhesively sealed to the top in a sealing area between the access opening and an adjacent edge of the top, and said sealing layer being operable to expose the access opening and reclosable against the top to seal the access opening;

means for pulling the sealing layer back to open the access opening; and a tamper-evident means located in the sealing area between the access opening and the adjacent edge of the container and constructed such that when the sealing layer opens the access opening for the first time, tamper evidence is provided and is visible after the sealing layer is reclosed.

12. The container according to claim 11, wherein the tamper-evident means comprises at least one elongated strip parallel to the direction of pulling the sealing layer back.

13. The container of claim 12, wherein said at least one elongated strip is formed from a portion of said top.

14. The container of claim 12, wherein one end of said at least one elongated strip falls into said container when said sealing layer is peeled back for a first time.

15. The container of claim 12, wherein said elongated strip comprises a tapered form with a knob extension end.

16. The container of claim 12, wherein said means for pulling the sealing layer back to open the access opening the sealing layer includes a starter portion at one end of said sealing layer and said elongated strip is located in the sealing area at the starter portion end.

17. The container according to claim 11, wherein the polygonal package is generally rectangular, and the direction of pulling back is parallel to the longer dimension of the rectangular shape, and including a pair of elongated strips substantially parallel to the longer dimension of the rectangular shape, one on each side of the access opening.

18. The container according to claim 11, wherein the sealing layer is transparent.

19. The container according to claim 11, wherein the access opening is sufficiently large to provide hand access to substantially all of the food product contained within the frame.

20. The container according to claim 11, wherein said means for pulling the sealing layer back to open the access opening the sealing layer includes a starter portion.

21. The container according to claim 20, wherein the starter portion is a tab.

22. A container for a food product comprising, a wrapper surrounding the food product, said wrapper forming a top of the container;

the top having an access opening so as to provide access to the food product;

a sealing layer adhesively sealed to the top in a sealing area between the access opening and an adjacent edge of the top, and said sealing layer being operable to expose the access opening and reclosable against the top to seal the access opening;

means for pulling the sealing layer back to open the access opening; and an elongated strip parallel to the direction of pulling the sealing layer back, said elongated strip located in the sealing area between the access opening and the adjacent edge of the package and constructed such that when the sealable layer opens the access opening for the first time, the elongated strip falls into said container.

23. The container of claim 22, wherein said elongated strip is formed from a portion of said top.

24. The container of claim 22, wherein the elongated strip comprises a tapered form with a knob extension end.

25. The container of claim 22, wherein said means for pulling the sealing layer back to open the access opening the sealing layer includes a starter portion at one end of said sealing layer and said elongated strip is located in the sealing area at the starter portion end.

26. The container according to claim 22, wherein the sealing layer is transparent.

27. The container of claim 22, further comprising a tray located inside said wrapper and upon which the food product is disposed.

28. The container of claim 27, wherein said tray comprises a frame.

29. The container of claim 28, wherein said tray defines a shape of the container.

30. A shaped food product container in combination with a food product contained therein, the overall structure of the container imparting a certain shape to the container, which shape is defined by structure other than the size or shape of food product within the container, the container further including a wrapper forming at least a portion of the exterior of the container and conforming to the imparted certain shape, the imparted certain shape causing the wrapper to have at least one outer surface access area which has an access opening so as to provide access to the food product within the container, and a sealing layer adhesively sealed to said outer surface access area so as to cover said access opening, said sealing layer being resealable and reclosable against said outer surface access area to seal said access opening when said sealing layer, after having been initially opened, is moved back against said outer surface access area.

31. The container in combination with a food product of claim 30, wherein the container has a top, a bottom, and sides conforming to the certain shape, and wherein the top forms the outer surface access area.

32. The container in combination with a food product of claim 31, wherein the top and bottom of the container are polygonal.

33. The container in combination with a food product of claim 32, wherein the top and bottom of the container are rectangular.

34. The container in combination with a food product of claim 30, wherein the wrapper is a flexible material.

35. The container in combination with a food product of claim 30, including a tray or trays within the wrapper, the food product located in the tray or trays and wherein the tray or trays impart the certain shape to the wrapper.

36. The container in combination with a food product of claim 35, wherein the tray or trays have open top or tops and the outer surface access area overlies the open top or tops of the tray or trays.

37. The container in combination with a food product of claim 30, wherein the wrapper forms substantially the entire exterior of the container.

38. The container in combination with a food product of claim 37, wherein the wrapper is a flexible material.

39. The container in combination with a food product of claim 30, wherein the access opening is large enough to provide hand access to the food product within the container.

40. The container in combination with a food product of claim 30, wherein the sealing layer includes a starter portion located at one side of the outer surface access area for grasping and pulling back the sealing layer to increase the size of the exposure of the access opening.

41. The container in combination with a food product of claim 40, wherein the sealing layer is shaped to releasably seal to a portion of the outer surface access area after the sealing layer, having been pulled back, is returned to a position covering the access opening.

42. The container in combination with a food product of claim 30, wherein the outer surface access area has graphics and wherein the sealing layer has graphics which align with the graphics of the outer surface access area.

43. The container in combination with a food product of claim 30, wherein the container comprises a package integrity feature which provides an indication that the container has been opened at least once.

44. The container in combination with a food product of claim 30, wherein the food product as is cookies.

45. The container in combination with a food product of claim 30, wherein the outer surface access area is generally flat.

46. A food container in combination with a food product located within the container, the food product being discrete food articles, a wrapper forming the exterior of the container and having an outer surface access area, the overall structure of the container imparting to the wrapper a certain shape, which certain shape is independent of the size or shape of the discrete food articles within the container, an access opening formed in the outer surface access area so as to provide access to the discrete food articles within the container, and a sealing layer adhesively sealed to the outer surface access area so as to cover the access opening, said sealing layer being releasable and reclosable against the outer surface access area around the access opening to seal the access opening after the sealing layer, having been initially opened, is moved back against the outer surface access area.

47. The container in combination with a food product of claim 46, wherein the container includes a top, a bottom, and sides, and wherein the outer surface access area is located in the top.

48. The container in combination with a food product of claim 47, wherein the container top is polygonal.

49. The container in combination with a food product of claim 46, wherein the outer surface access area is generally flat.

50. The container in combination with a food product of claim 46, wherein the wrapper is a flexible material.

51. The container in combination with a food product of claim 46, including a tray or trays within the wrapper, the food product located in the tray or trays and wherein the tray or trays impart the certain shape to the wrapper.

52. The container in combination with a food product of claim 46, wherein the access opening is large enough to provide hand access to the food product within the container.

53. The container in combination with a food product of claim 46, wherein the sealing layer includes a starter portion located at one side of the outer surface access area for grasping and pulling back the sealing layer to increase a size of an exposure of the access opening.

54. The container in combination with a food product of claim 53, wherein the sealing layer is shaped to releasably seal to a portion of the outer surface access area after it, having been pulled back, is returned to a position covering the access opening.

55. The container in combination with a food product of claim 46, wherein the container comprises a package integrity feature which provides an indication that the container has been opened at least once.

* * * * *

UNITED STATES PATENT AND TRADEMARK OFFICE

CERTIFICATE OF CORRECTION

PATENT NO. : 7,344,744 B2
APPLICATION NO. : 11/029651
DATED : March 18, 2008
INVENTOR(S) : Sierra-Gomez et al.

It is certified that error appears in the above-identified patent and that said Letters Patent is hereby corrected as shown below:

In column 7, line 49, please change “lease” to -- least --.
Also, in column 10, line 41, please change “product as is cookies” to -- product ~~as~~ is cookies --.

Signed and Sealed this

Twenty-eighth Day of July, 2009

JOHN DOLL
*Acting Director of the United States Patent and Trademark Office*